United States Patent [19]

Prigmore et al.

[11] Patent Number: 4,779,514

[45] Date of Patent: Oct. 25, 1988

[54] PORTABLE BUILDING

[75] Inventors: Phillip M. Prigmore; Vernon L. Prigmore, both of Alva, Okla.

[73] Assignee: Miracle Enterprises, Ltd., Capron, Okla.

[21] Appl. No.: 63,682

[22] Filed: Jun. 19, 1987

[51] Int. Cl.[4] ..... E04H 1/12

[52] U.S. Cl. ..... 52/79.5

[58] Field of Search ..... 52/79.5, 79.7, 66, 69, 52/143, 64, 234, 79.1, 70, 71

[56] References Cited

U.S. PATENT DOCUMENTS

| | | | |
|---|---|---|---|
| 1,156,693 | 10/1915 | Koger | 52/79.7 |
| 2,765,499 | 10/1956 | Couse et al. | 52/79.5 |
| 3,103,709 | 9/1963 | Bolt | 52/79.5 |
| 3,284,966 | 11/1966 | Bolt | 52/79.5 |
| 3,348,344 | 10/1967 | Tatevossian | 52/79.5 |
| 3,632,153 | 5/1970 | Knudsen | 52/66 |
| 3,849,952 | 11/1974 | Hanaoka | 52/79.5 |
| 3,984,949 | 10/1976 | Wahlquist | 52/143 |
| 4,166,343 | 9/1979 | O'Brian | 52/69 |
| 4,478,467 | 10/1984 | Tyndall | 52/36 |

FOREIGN PATENT DOCUMENTS

| | | | |
|---|---|---|---|
| 676997 | 8/1952 | United Kingdom | 52/66 |

*Primary Examiner*—James L. Ridgill, Jr.

*Attorney, Agent, or Firm*—Laney, Dougherty, Hessin & Beavers

[57] ABSTRACT

A modular, portable building unit susceptible to air transport and including a roof, foldable side walls and foldable end walls having the same width as the height of the side walls. Three of the modular building units can be interfitted to form a building having four times as much floor space as the single modular building unit. The inclusion of a floor in the modular building unit is optional.

11 Claims, 3 Drawing Sheets

PORTABLE BUILDING

FIELD OF THE INVENTION

This invention relates to portable buildings, and more particularly, to buildings which can be flattened by folding, can be transported by air and can be integrated with each other in modular fashion to make an enlarged edifice.

BRIEF DESCRIPTION OF THE PRIOR ART

Many types of collapsible buildings have previously been proposed, and in many instances, the light weight and reduced bulk of the building, when collapsed, enable it to be easily transported. In some cases, air transport of the building is facilitated.

A need continues to exist in battlefield situations for air-transportable buildings which can be very quickly erected in a field location, and which are sufficiently flexible in the manner in which they can be utilized to permit the size and shape of the building which is to be erected to be varied in accordance with the particular needs at hand.

One type of collapsible hut which has been heretofore proposed is that which is described and illustrated in Couse U.S. Pat. No. 2,765,499. The collapsible building shown in the Couse patent can be folded down into a semi-flattened state for transportation, and may be placed in a shipping container. This building is self-contained in all of its essential components. The unit described in the Couse patent has foldable side panels and floor panels, and these panels can be collapsed or folded about a rigid rectangular central frame positioned in each end section of the hut so as to make the hut storable in a shipping container. The roof of the hut is elevated by suitable jacks when the hut is to be erected from its collapsed condition. A plurality of the buildings can be joined in end-to-end relationship to each other for use as a field hospital, if desired. The Couse collapsible hut includes flexible end panels which cannot be pulled out or removed and used for side walls, and units of the collapsible hut cannot be joined to each other in side-by-side relation. While the canvas end wall of the Couse hut can be made in various shapes, it has no supporting means, and the Couse collapsible hut has no internal shelving or power supplies provided as an integral part of the design which are kept in place in operative status and transported with the structure.

U.S. Pat. No. 4,478,467 to Tyndall discloses a portable work shop which has a number of shelves and tables built into place, and which can be transported by movement on rollers after being folded into a box-like configuration. When the shelving and the power supply which are a part of this portable work shop are in use, however, the multiple-hinged panels are folded out so that the entire work shop is not enclosed.

Bolt U.S. Pat. No. 3,103,709 illustrates and describes a building unit which can be collapsed or folded downwardly into a low and compact status to thereby facilitate transport over highways by truck of several units stacked one upon the other. The building unit can be quickly and readily erected. Several of the units can be joined to each other to form a larger building.

Another patent issued to H. C. Bolt, U.S. Pat. No. 3,284,966, is also concerned with a collapsible building. In this patent, the building which is provided has wall panels which will fold down flatly against the floor.

The collapsible building of Bolt can be quickly assembled and erected at a variety of field sites.

Collapsible structures are shown in U.S. Pat. No. 4,166,343. In these structures, the side walls are hinged along a line extending horizontally across the middle portion of each side wall so that the upper panel and the lower panel of the side wall can be folded flatly against each other by pivotation of the two panels about the hinge line.

Wahlquist U.S. Pat. No. 3,984,949 describes and depicts a portable room structure in which the walls are divided into two panels which are pivotally interconnected at their mid-sections for pivotation along a vertical line so that the end walls, which the two side walls interconnect, can be folded together with the two halves of the side walls folded flat against each other between the end walls. When the walls are opened out to expanded, room enclosing position, certain sliding bolt structures function as anchors for fixing the position of the wall panels relative to each other. When the portable room is in its opened-out or unfolded condition, the slidable bolts function to lock the wall panels to the floor. A ceiling unit or panel can be lifted up or lowered into registry with the upper end of the wall panels to provide a covering for the portable room.

Hanaoka U.S. Pat. No. 3,849,952 discloses a house which is constructed of prefabricated foldable assemblies which can be folded into compact form for transport, and then set up to assemble the house at the site where it is to be built. The house, when assembled, includes a plurality of horizontal structural units which are disposed one above the other, and a foldable supporting structure for supporting the adjacent horizontal structural element at the ends thereof. Locking devices are mounted on the pivot of each assembly so that the pivot can be fixed when the assembly is opened up.

The walls of the structure contemplated by this patent are two-part walls connected along a horizontal hinge line extending between the top portion of the wall and the bottom portion thereof so that the wall can be collapsed inwardly and the ceiling (or floor on multistored structures) can be lowered when the building is to be collapsed into its compact status.

Tatetossian U.S. Pat. No. 3,348,344 is a transportable building which includes a plurality of walls constructed of dual panels pivotable with respect to each other about a vertical axis, so that the panels can be folded to a flat, superimposed position with respect to each other. When the wall panels have been folded in this way, the outer portions of the roof can be folded downwardly along and parallel to the side walls. This makes a compact, easily transportable building which can be conveyed to a required site in compact, folded accordian-style, and then opened out to provide full living accommodations. In the prefabricated compact form, the central portion of the building includes the electrical utilities, heating, plumbing and wiring for the entire building.

Koger U.S. Pat. No. 1,156,693 is a portable room mounted on wheels which can be constructed so that two or more of these rooms can be placed side-by-side to double or triple the size of the space available within the contained and enclosed structure. In general, this is accomplished by raising the side wall of one of the rooms to make a roof or an intermediate space between the two adjacent or side-by-side rooms. A facing wall on the adjacent unit is let down to make a floor for this intermediate space. A door is pivotally or slidably mounted adjacent the two ends of each of the side-by-side units, and these doors are laterally movable, either by pivotation or by sliding, so as to abut end-to-end so as to collectively define a pair of end walls which enclose, along with the folded outside walls forming the ceiling and the floor, the space between the two side-by-side units. In one modified form of the structure depicted and described in the Koger patent, the end walls are hinged to the floor and can be folded or collapsed when they are not in use.

O'Brian et al U.S. Pat. No. 4,166,343 discloses a building which can be collapsed or folded by pivoting the side walls about a central fold or hinge line which divides each side wall into two panels. The side walls are folded downwardly and inwardly to a flattened, superimposed status. The roof is lowered to rest upon the folded down side walls. The two end walls of the structure also fold inwardly about hinges which pivotally connect the top of the end walls to the ceiling. It is apparent by reference to the drawings of this patent, and to the disclosure therein, that the end walls which are provided are of lesser width than the height of the side walls, and thus the collapsible structure shown in the O'Brian et al patent cannot be utilized by adjoining several modular units in the same way as the modular building units of the present invention.

BRIEF DESCRIPTION OF THE PRESENT INVENTION

This invention is a highly utilitarian, paneled building which can be transported by air from one location to another in either erected or a collapsed status. It is particularly useful as a portable, self-contained field hospital, though it is not limited to such use. Many of the salient aspects of the invention disclosed in this application were also disclosed in our Disclosure Document No. 144443 filed in the U.S. Patent and Trademark Office on Jan. 10, 1986. That Disclosure Document is incorporated herein by reference.

Broadly described, the present invention comprises a modular building unit of generally rectangular, parallelepiped configuration. The building unit has a pair of opposed, parallel side walls and a pair of opposed, parallel end walls which extend between the side walls. The roof for the building unit may be flat or pitched, and the building unit may or may not have a floor. The building preferably does include a flat, horizontally extending ceiling.

The modular building unit is relatively lightweight and it is collapsible to facilitate ease of transport, either by air or over-the-road vehicle, and also to enable the building to be quickly erected or folded into a compact condition. Each of the side walls has a height which is substantially equivalent to the width of each end wall, and each side wall is of a two-part construction including an upper part and a lower part which is hingedly interconnected to the upper part for mutual pivotation of the two parts about a common horizontal axis. Each end wall is hingedly secured along either a top or bottom edge to the respective roof panel or ceiling or floor, where one is used, and can be folded flat against the ceiling or floor in a horizontally extending position when the building unit is collapsed.

In a preferred embodiment of the invention, a removable roof assembly is utilized which provides run-off capability, yet allows flat, stable packing of the building when shipping or storing.

The removable roof assembly includes an elongated tubular ridge beam which is joined at its opposite ends to the center of each of a pair of elongated end beams which extend parallel to each other and are preferably of a tubular character. The ridge beam and the end beams are of the same size, and are preferably two inch square tubing. At the opposite sides of the removable roof assembly, a pair of elongated tubular eave elements extend from one end of the roof to the other, and each of these eave elements is joined at its opposite ends to the tubular end member. The eave elements are of a substantially lesser thickness than the tubular end members and the ridge member, so that flat roof plates extended between the ridge member and the two opposed parallel eave elements slope from the ridge line at the center of the roof structure outwardly and downwardly, and provide drainage and run-off. The flat roof plates are preferably supported by a plurality of spaced one inch angle iron bracing elements.

An important object of the present invention is to provide a pair of modular building units which can be joined together in end-to-end or side-by-side relation so that the total confined sheltered space can be augmented or increased in a selective fashion.

Another important object of the invention is to provide a modular building unit which can be collapsed or folded downwardly so that one can be stacked on top of the other in such folded down position. The units can be moved one at a time on a single truck, or by means of an aircraft or helicopter, and the transportable units do not exceed highway regulations as to height, width or weight limitations.

An additional object of the invention is to provide a portable modular building unit which can be easily transported by air, and can be set down in remote locations and there rapidly erected to provide a sturdy building which is especially useful as a field hospital, but which can also be employed for a number of other uses, if desired. For example, an internally pressurized version of this building could be used in space as a research laboratory; or the building could be used as an isolation ward for communicable diseases. The building also offers many civilian uses, such as a seasonal cover for an outdoor swimming pool or a greenhouse.

Another object of the invention is to provide a modular building unit which can be collapsed or folded down to a flat, transport position, or can be quickly erected to a sturdy building in a field location, with erection or folding down to the transport position taking from about ten to about fifteen minutes.

Another object of the present invention is to provide a portable building which can be air lifted from one location to the other, and which contains within the building, self-contained medical instrumentation, including multiple surgical stations, x-ray equipment, anesthesia and monitoring equipment, surgical lights, film developing facilities, and the like, all of which can be allowed to remain in an operative position and in a ready-to-use state, even when the building is collapsed or folded down for transport.

A further object of the invention is to provide a portable, modular building unit which can be quickly folded down into a flat status to facilitate transport and storage, and which can optionally be constructed to include a floor, and which can be selectively fabricated from many different materials.

A further object of the invention is to provide a modular building unit which can be equipped with a flatstacking roof system or assembly, but which nevertheless provides sufficient pitch to afford rain run-off from the roof.

Additional objects and advantages will become apparent as the following detailed description is read in conjunction with the accompanying drawings which illustrate certain preferred embodiments of the invention.

GENERAL DESCRIPTION OF THE DRAWINGS

DETAILED DESCRIPTION OF A PREFERRED EMBODIMENT OF THE INVENTION

Figure 1:
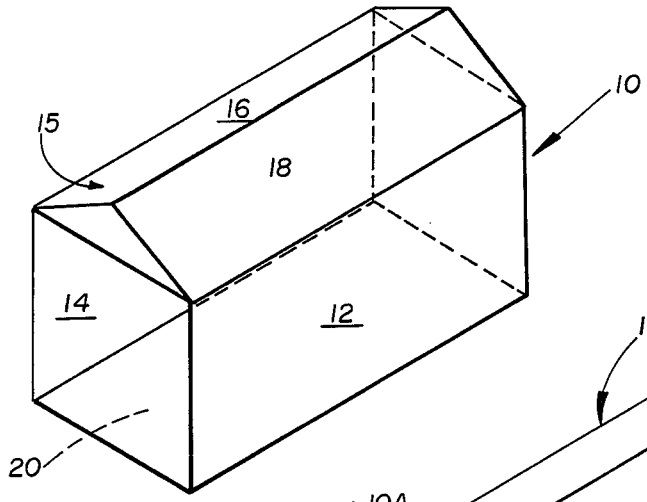
FIG. 1 is a perspective view of a modular building unit constructed in accordance with the present invention.

Referring initially to FIG. 1 of the drawings, shown therein is a modular building unit 10 constructed in accordance with the present invention. The modular building unit 10 includes a pair of opposed, parallel rectangular side walls 12 and a pair of opposed, parallel rectangular end walls 14 which extend between the side walls 12 and interconnect the side walls at their opposite ends. A single gabled roof 15 is shown in use on the modular building unit, and includes a pair of inclined panels 16 and 18. It should be pointed out that various other roof structures, including a flat roof, can also be utilized. Preferably the roof, when gabled, can be lifted up and removed from the substructure made up of the walls 12 and 14. The modular building unit 10 may or may not include a floor 20.

The end walls 14 are each preferably square and thus of a width which corresponds to the height of the two side walls 12. This relationship facilitates the joinder of several of the modular building units 10 to each other in a manner and for a purpose hereinafter described.

As will be hereinafter explained in greater detail, the end walls 14 of the modular building unit can each be removed. Such removal of two adjacent end walls 14 has been carried out in the case of two of the modular building units 10 to permit the two units to be joined together in the manner shown in FIG. 2 of the drawings. Here, one of the end walls 14 from each of the two units **10*a* and 10*b*** has been removed so as to communicate the interior of the two units with each other as the ends are abutted and joined to form a single elongated building structure.

Figure 2:
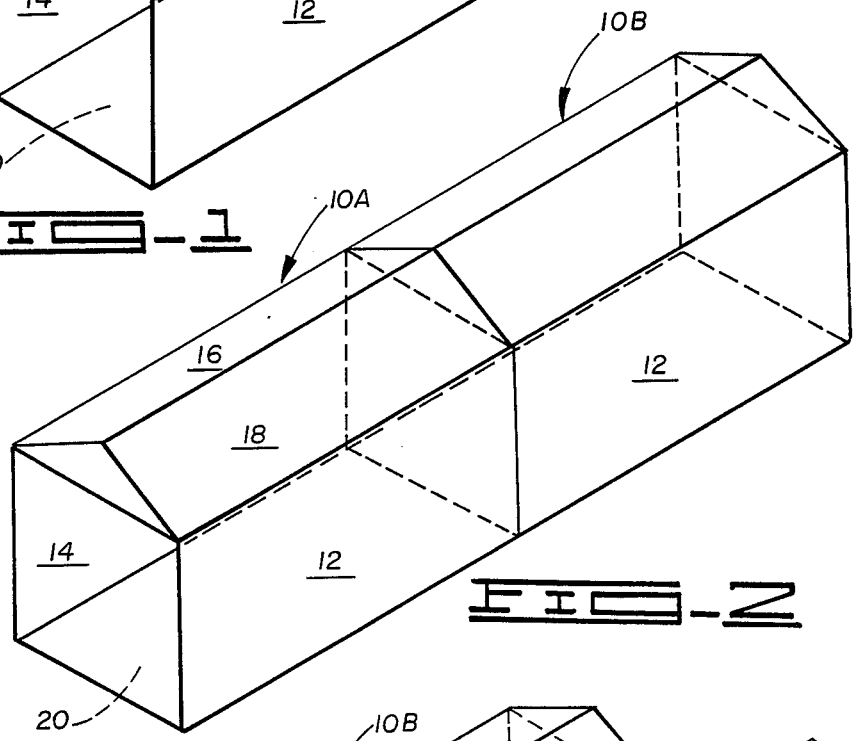
FIG. 2 is a view showing two of the modular building units connected together in end-to-end relation.
Figure 3:
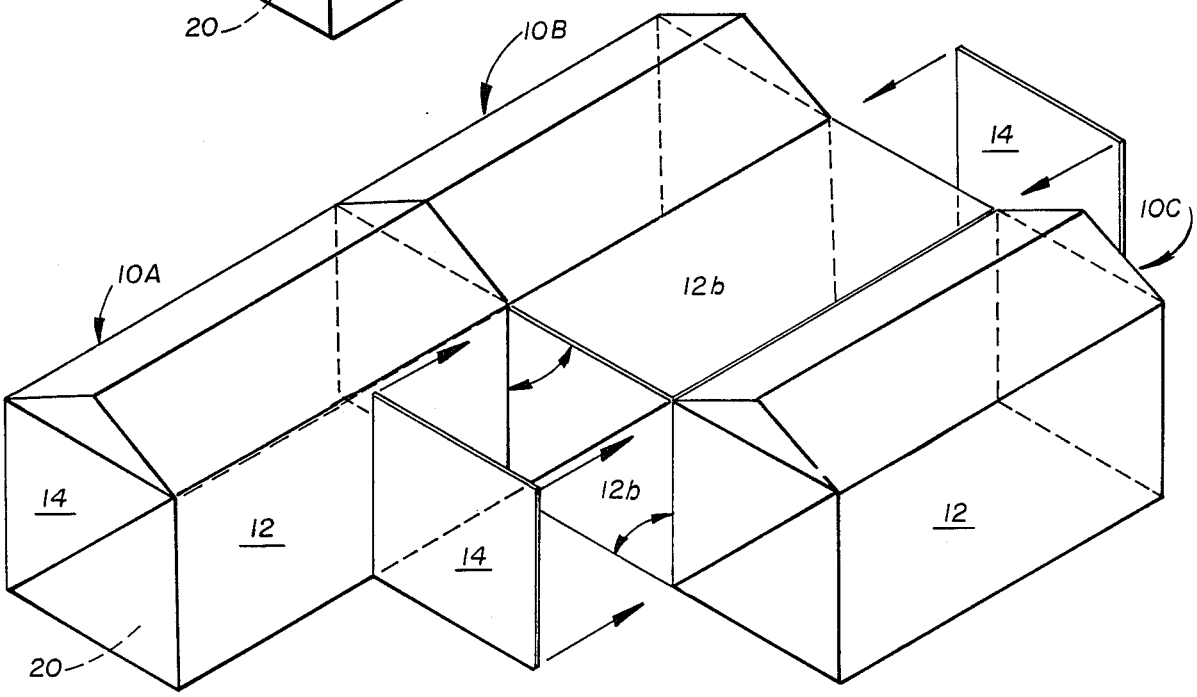
FIG. 3 illustrates the manner in which three of the modular building units can be interconnected to form a building having a total floor space area which is four times as large as the floor space area of one of the modular building units.

In FIG. 3 of the drawings, a method is illustrated by which three of the modular building units 10A, 10B and 10C, can be joined to form a highly utilitarian structure having four times the floor space that is characteristic of a single one of the building units. In order to join the three building units to form the structure illustrated in FIG. 3, two of the units 10A and 10B are first joined as shown in FIG. 2. In this joinder, it will be recalled that an end wall 14 from each of the two units has been removed to communicate the interior of the units with each other. To then complete the joinder of three of the units to each other by the method shown in FIG. 3, a side wall **12*a* on the unit 10B is pivoted upwardly until it occupies a substantially horizontally, extending plane as is illustrated in FIG. 3. Connected to the outer edge of the side wall 12*a* as thus pivoted upwardly is a third modular building unit 10C, and the side wall 12*b* of this third building unit which faces the building unit 10B is then folded down to a flat, horizontally extending position, and thus becomes the floor of the dogtrot, or connecting space between building units 10B and 10C when these are coupled together as shown in FIG. 3**.

Figure 4:
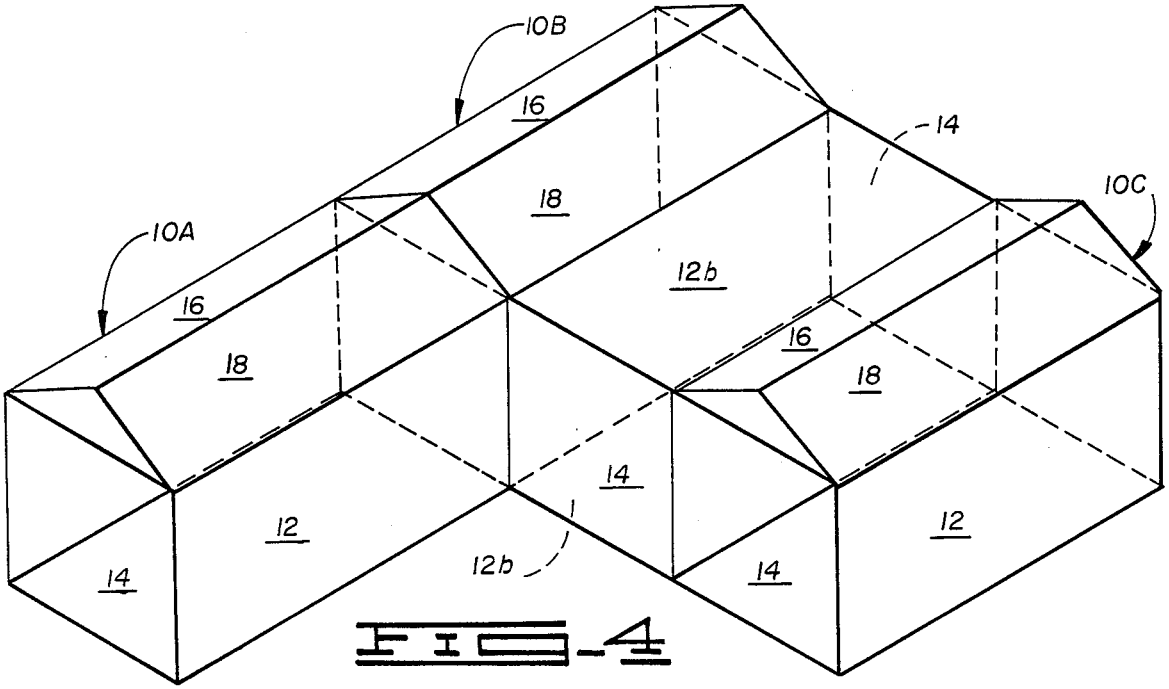
FIG. 4 shows the three interconnected buildings after they have been interengaged.

In a preferred method of completing the three unit building, the two end walls 14 initially removed from the two abutting building units 10A and 10B are secured in opposed, parallel positions to close the openings to the space defined between the side walls **12*a* and 12*b* of building units 10B and 10C, respectively. The closure of the openings at the ends of this space by movement of the end panels 14 inwardly is illustrated schematically by the arrows in FIG. 3. FIG. 4 then shows the appearance of the composite structure after these end panels 14 have been secured in position. Securement of the end panels 14 can be by any suitable means, but is preferably an arrangement where the two end panels can be pivoted upwardly against the ceiling or overhead panel formed by the side wall 12*a* of the unit 10B** after the same has been pivoted to a functional roof position.

As exemplary of the versatility of the modular building unit of the present invention, the end walls or panels 14, rather than being used to close the openings to the space between the horizontally extending side walls **12*b* and 12*a*, can be left off of the structure so that the space remains open at opposite ends. Thus, it will be possible to drive vehicles into this space and have the vehicles parked in a covered zone, with ready access to the vehicles from the open sides of either building units 10*b* or 10*c***. In a military field hospital, this is particularly desirable where ambulances need to be in a covered position as the wounded are unloaded and moved into the hospital accommodations.

Figure 5:
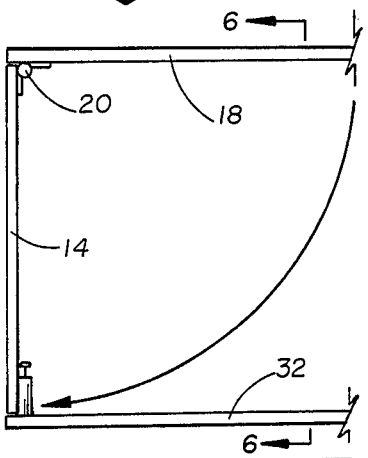
FIG. 5 is a detail view illustrating the manner in which one of the end walls employed in the building structure of the invention can be pivoted to allow the building to be folded down to a flattened condition.
Figure 6:
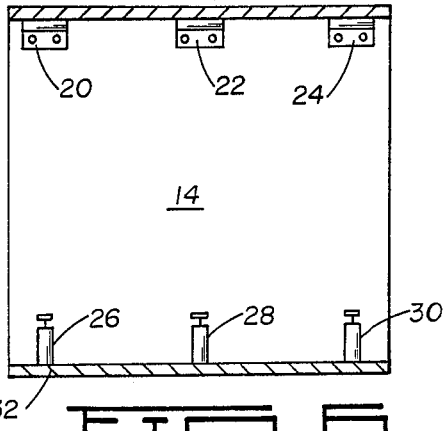
FIG. 6 is an elevation view of one of the end walls shown in FIG. 5, and depicting a hinge structure used to hinge the end walls to the roof panel of the modular building unit, and also showing latching devices used to latch the lower portion of the end wall to a floor panel.

By reference to FIGS. 5 and 6, it can be perceived how the end walls 14 can be mounted in one of the modular building units to facilitate folding upwardly to a flat, transport status. These figures also illustrate how each end wall may be removed in order to abut two units in end-to-end relation, as shown in FIG. 2. Each end wall 14 is pivotally secured to a horizontally extending ceiling panel 18 so that the end wall can be pivoted upwardly at a time when it is desired to collapse or fold down the building unit as hereinafter explained. This capability also allows the building unit to be opened at one end for ease and immediacy of ingress, if desired. Each of the multiple hinge structures 20, 22 and 24 utilized for pivotally supporting the end walls 14 along a horizontal line of connection to the roof panel 18 are such that the pintles of the hinge structures can be easily knocked out to allow the knuckles of each pair of cooperating hinge plates to be disconnected from each other.

The lower portion of each of the end walls 14 is detachably retained in position, and the end walls are held in a vertical plane, by means of the reciprocating bolt-type stops or latches 26, 28 and 30 carried on the lower portion of the respective end wall adjacent a bottom panel or floor 32 shown in use in the illustrated embodiment of the building unit. When the spring-biased pins or bolts which characterize the latch units have been retracted or withdrawn upwardly, the end wall or panel 14 can be quickly and easily pivoted upwardly to facilitate collapse or fold down of the building unit. Alternatively, the respective end walls can be completely removed at this time if the hinge pintles have been knocked out to disconnect the hinge structures 20, 22 and 24.

Figure 11:
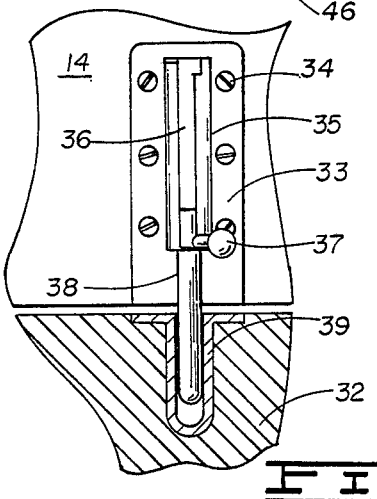
FIG. 11 is a structural detail view, partially in section and partially in elevation, illustrating the manner in which a latching mechanism used in the invention is constructed.

In FIG. 11, there is illustrated one type of latch which can be utilized to secure the lower edge portion of each of the end walls 14 to the floor 32. These types of latches are well known, and such structures generally include a plate 33 which is secured to the respective end wall 14 by screws or other suitable fasteners 34. The plate 33 includes a central, semi-cylindrical bolt track 35 which carries a central slot 36. The central slot 36 accommodates a knobbed handle 37 carried on a sliding bolt 38. The sliding bolt 38 can be extended or retracted within the bolt track 35 by moving the bolt by means of the handle 37. In securing the wall to the floor 32, the bolt 38 is extended into a receiving sleeve or tube 39 which is set into the floor.

It should be pointed out that in one embodiment of the invention side walls 12 are preferably fitted with bolt-type stops or latches similar to those carried on the end walls 14, and shown generally in FIG. 6 by reference numerals 26, 28 and 30, and illustrated in detail in FIG. 11.

It is also generally desirable to provide a means for interconnecting and latching the vertical end edges of the side walls and of the end walls to each other. This can also be accomplished by means of bolt and socket-type latches of the type shown in FIG. 11, or a variety of other types of interconnecting structures. Such latching between the end and side walls is particularly desirable where the building, for weight-reduction reasons, as well as for reducing expense of construction, contains no floor. Such might very well be the type of construction used in certain battle situations where it is not critical that a floor be provided, but rather the shelter and protection afforded by the side walls and end walls and roof are the critical aspects of the building's functionality.

Figure 7:
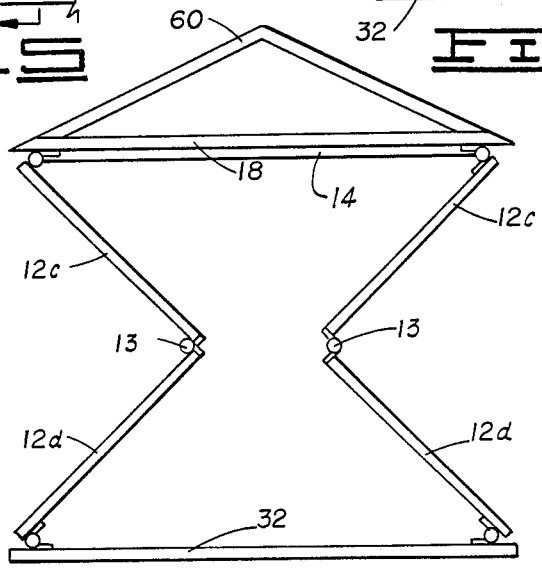
FIG. 7 illustrates the manner in which side walls utilized in a modular building unit of the invention can be folded inwardly to permit the entire building to be folded down into a compact state preparatory to transport thereof.

As contrasted with the use of quick release latches for detachably securing the end walls to the floor, the side walls are preferably hinged at both the top and the bottom to the roof and floor respectively, and can be made to pivot inwardly in the fashion shown in FIG. 7. Thus, as there depicted, each of the side walls 12 provided in the embodiment of the invention there illustrated, includes a pair of substantially equi-sized panels **12*c* and 12*d*. The panels 12*c* and 12*d* of each wall are vertically aligned to form the side wall when the building is erected and in its operative status. The panels 12*c* and 12*d* are, however, pivotally interconnected by means of an elongted hinge 13 which extends horizontally at the central location of the expanded or erect side walls where the side panels 12*c* and 12*d* meet and are connected. With the top horizontal edge of each upper side wall panel 12*c* then hinged to the roof structure 18 by suitable hinges, and the lower horizontal edge of the lower panel 12*d* hingedly interconnected to the floor 32 in a similar fashion, the building unit can be collapsed into a low profile, compact shape more suitable for transport. This is accomplished by collapsing or folding the two side wall sections 12*c* and 12*d* of each of the two side walls inwardly in the manner shown in FIG. 7. Thus, the upper panel 12*c* and lower panel 12*d* pivot on the hinge line 13 and ultimately move into flatly abutting juxtaposition to each other. In this position both panels occupy parallel, closely adjacent planes with respect to each other and with respect to the plane of the floor 32**.

It should be pointed out that the ceiling 18 can be surmounted by various types of roof structures, including flat roofs or a roof of the type shown in FIGS. 8–9 and hereinafter described, or a gabled roof 60 of the type shown in FIG. 7. It will also be noted in referring to FIG. 7 that at the time the side walls 12 are collapsed in the manner there illustrated, the end walls 14 of the structure have either been removed or folded upwardly against the ceiling 18 to the transport position following the release of the lower edge of the two end walls 14 from the floor 32, by releasing the several latches 26, 28 and 30.

It should be further pointed out with respect to the embodiment of the invention depicted in FIG. 7 that the upper and lower panels **12*c* and 12*d* of each of the side walls 12 carry parts of cooperating latch devices which are the type shown in FIG. 11 so that, when a bolt 38 forming a movable element within the latch structure secured near the lower edge of the upper panel 12*c* is extended, it can be made to enter a suitable sleeve 39 carried on the lower panel 12*d* to thereby prevent the two panels 12*c* and 12*d* of each side wall 12 from collapsing inwardly to the transport position when it is intended that the building stand erect, and be mechanically sturdy in that configuration. The latch structures, could, of course, be as adequately located on the outer side of the building, as contrasted with the inner side, as shown in FIG. 7, and in such an arrangement, the sleeves 39** could even be eliminated in the most economical and simplest form of the structure.

Figure 8:
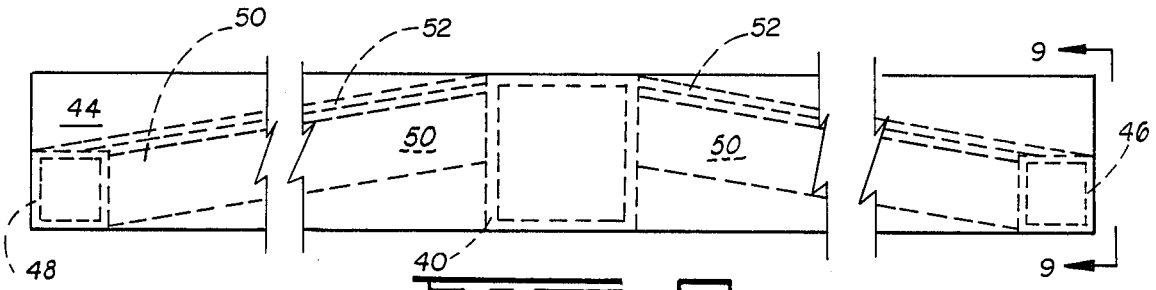
FIG. 8 is an end elevation view of one type of roof structure which is constructed in accordance with one embodiment of the invention, and is useful for roofing one of the modular building units of the invention.
Figure 9:
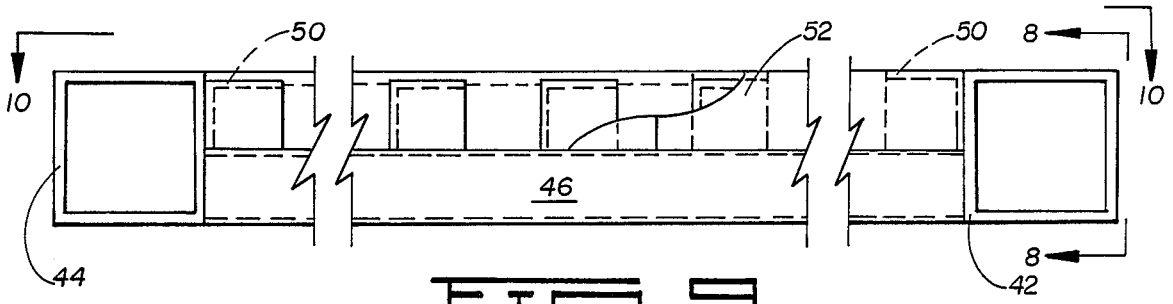
FIG. 9 is a side elevation view of the roof structure shown in FIG. 8.
Figure 10:
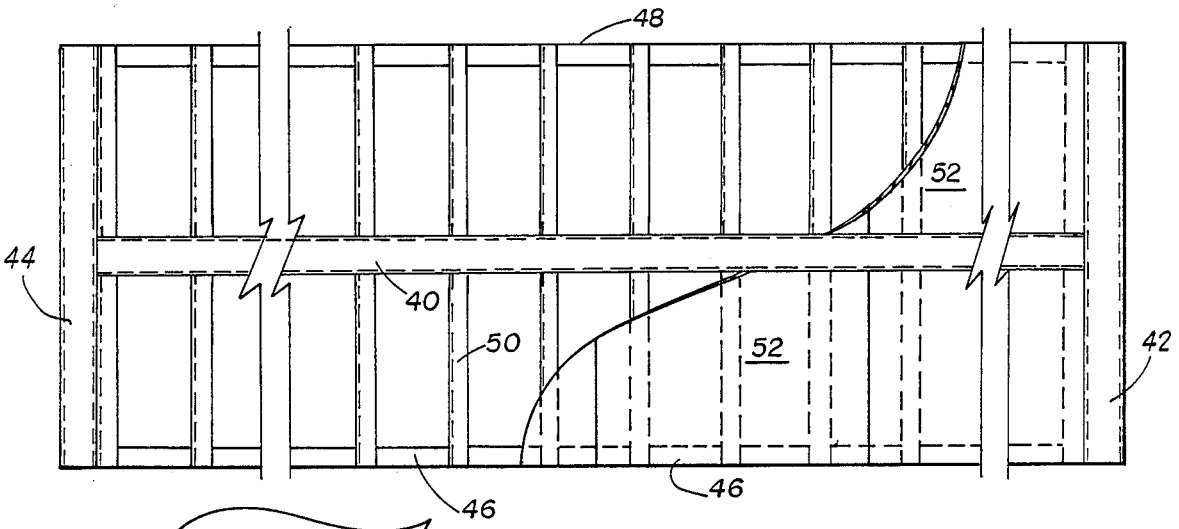
FIG. 10 is a top plan view showing the roof structure illustrated in FIGS. 8 and 9.

In FIGS. 8, 9 and 10, one type of roof structure which is particularly suitable for use in the portable building unit of the present invention is illustrated. The roof structure includes an elongated tubular ridge beam 40 which is preferably of square cross-sectional configuration, with the walls of the tubing being two inches in thickness. The tubular ridge beam 40 is joined at its opposite ends to the centers of each of a pair of elongated end beams 42 and 44 which extend parallel to each other, and are also preferably tubular and preferably of square cross-section. The end beams 42 and 44 are of the same size as the ridge beam 40, and thus in a preferred embodiment, are 2"×2" in dimension.

Extending parallel to the ridge beam 40 and spaced equidistantly on opposite sides thereof are a pair of elongated tubular eave elements or eave beams 46 and 48. The elongated eave beams or elements 46 and 48 are each tubular elements having a one inch square cross-section. The eave beams 46 and 48 are joined at their opposite ends to the transversely extending end beams 42 and 44. Extended between the upper side of the central tubular ridge beam 40 and the upper side of each of the parallel eave beams 46 and 48 are a plurality of angle elements 50 each having a pair of one inch legs joined at a right angle corner. The one inch angle elements 50 are extended between the ridge beam 40 and the eave beams 46 and 48 so that one of the flanges of each angle faces upwardly, and thus affords support for a plurality of flat roof panels 52.

It will be perceived that this construction requires the roof structure to be characterized by a slight pitch which will enable it to shed water and provide adequate run-off. Importantly, too, however, the roof structure can be quickly and easily placed on the building unit 10 so as to be supported by the side walls 12 and the end walls 14 when they are in their upright or expanded position. When the building unit 10 is collapsed or pivoted down to a flattened position, the roof structure can be supported flatly thereon by reason of being completely contained within the dimensional limits of the two end beams 42 and 44 which are the same size (two inch thickness) as the central ridge beam 40, and are substantially larger, in thickness, than the two side eave beams 46 and 48. It will also be noted that this roof construction facilitates the securement to the underside thereof of flat, horizontally extending roof panels, such as the panel 18 shown in FIGS. 5 and 6.

Although a preferred form of roof construction has been illustrated, it will be appreciated that other types of roofs can be used on the portable building unit of the invention. All changes and innovations of this type which do not involve departures from the basic principles of the invention are deemed to be circumscribed by the spirit and scope of the invention, except as the same may be necessarily limited by the appended claims or reasonable equivalents thereof.

What is claimed is:

1. A modular, portable building unit comprising:

a pair of parallel side walls;

a flat ceiling extending over and between said side walls, and pivotally connected thereto to allow at least the upper part of said side walls to be pivoted toward a fold-up position in which they extend parallel to the plane of the ceiling;

hinges pivotally connecting each of said side walls to the flat ceiling at opposite sides of the ceiling to permit said side walls to pivot through 180° from said fold-up position to a position extending horizontally outwardly from said flat ceiling in substantially coplanar alignment with the ceiling, said hinges thus facilitating the extension of one of said side walls in a horizontally extending direction at the ceiling line of the building unit whereby two of said building units can be positioned in parallel relation along side each other and spaced from each other by a distance equal to the height of said side walls, and a side wall of one of said building units then folded outwardly into a horizontally extending position to form a ceiling over the space between said side-by-side parallel building units, with said space opening into one of at least said building units;

a pair of end walls extending between and interconnecting said parallel side walls and having a width equal to the height of said side walls, each of said end walls having an upper edge pivotally connected to said ceiling for pivotation about a horizontal axis to facilitate pivoting each end wall up against the ceiling;

each of said side walls having upper and lower parts of substantially equal size pivotally joined to each other along a horizontally extending center line of pivotation extending parallel to the plane of the ceiling, said upper and lower parts of each of said side walls being pivotable into superimposed juxtaposition to each other as said upper part is pivoted inwardly and upwardly toward said ceiling.

2. A modular, portable building unit as defined in claim 1 wherein each of said end walls is square and has a height and width equal to the height of each of said side walls, and wherein each of said end walls is readily removable from said building unit whereby three of said units can be joined to each other in an L-shaped configuration to enclose therewithin four times as much space as is enclosed in each of said building units.

3. A modular, portable building unit as defined in claim 1 wherein said end walls are detachable from said side walls and ceiling and are removable from the building unit to permit a plurality of said units to be joined in end-to-end relation with a continuous, communicating space defined within the joined units.

4. A modular building unit as deifned in claim 3 wherein said end walls are detachable from said side walls and ceiling and are removable from the building unit to permit a plurality of said units to be joined in end-to-end relation with a continuous, communicating space as defined within the joined units.

5. A modular, portable building unit as defined in claim 1 and further characterized as including:

a horizontally extending floor; and means for detachably latching the lower edges of said end walls to said floor.

6. A modular, portable building as defined in claim 5 wherein each of said walls is hingedly connected to said horizontally extending floor by hinges facilitating pivotation of each of the side walls through 180° about a horizontally extending pivotal axis whereby each of said side walls can be pivoted into a position extending horizontally away from the modular portable building unit which carries it to thereby floor the space between parallel units positioned alongside each other, and spaced by a distance equivalent to the height of said side wall.

7. A modular, portable building unit comprising:

a pair of parallel side walls;

ceiling means extending over and between said side walls, and pivotally connected thereto to allow said side walls to be pivoted toward a fold-up position in which they extend substantially horizontally;

a pair of end walls extending between, and interconnecting, said parallel side walls, and having a width substantially equal to the height of said side walls, each of said end walls having an upper edge pivotally connected to said ceiling means for pivotation about a horizontal axis to facilitate pivoting each end wall upwardly into a substantially horizontal plane;

said ceiling means including:

a roof structure which extends over and above said side walls and end walls, said roof structure comprising:

a centrally located, elongated ridge beam;

a pair of parallel end beams located at opposite ends of said elongated ridge beam and each being secured at its center to an end of said elongated ridge beam, said end beams each having a thickness equivalent to said ridge beam;

a pair of parallel, horizontally-spaced, elongated eave beams extending parallel to said ridge beam and disposed on opposite sides thereof, each of said eave beams having its opposite ends joined to ends of the parallel end beams, and each of said eave beams having a thickness substantially less than the thickness of said ridge beam, and each of said eave beams being joined to said end beams so that the lower surface of each eave beam is in coplanar alignment with the lower surfaces of said end beams; and roof panels spanning the space between said ridge beams and said eave beams, and sloping from the ridge beam downwardly toward the eave beams when the end beams and said eave beams are supported by the upper sides of said side walls and end walls when the side walls and the end walls are pivoted to their extended, operative positions.

8. A modular, portable building unit comprising:

a pair of parallel side walls;

a flat ceiling extending over and between said side walls, and pivotally connected thereto to allow at least the upper part of said side walls to be pivoted toward a fold-up position in which they extend parallel to the plane of the ceiling;

a pair of end walls extending between and interconnecting said parallel side walls and having a width equal to the height of side walls, each of said end walls having an upper edge pivotally connected to said ceiling for pivotation about a horizontal axis to facilitate pivoting each end wall up against the ceiling;

each of said side walls having upper and lower parts of substantially equal size pivotally joined to each other along a horizontally extending center line of pivotation extending parallel to the plane of the ceiling, said upper and lower parts of each of said side walls being pivotable into superimposed juxtaposition to each other as said upper part is pivoted toward said ceiling;

a roof structure disposed over said ceiling and including:

a centrally located, elongated ridge beam;

a pair of parallel end beams located at opposite ends of said elongated ridge beam and each being secured at its center to an end of said elongated ridge beam, said end beams having a thickness equivalent to said ridge beam;

a pair of parallel, horizontally-spaced, elongated eave beams extending parallel to said ridge beam and disposed on opposite sides thereof, each of said eave beams having its opposite ends joined to ends of the parallel end beams, and each of said eave beams having a thickness substantially less than the thickness of said ridge beam, and each of said eave beams being joined to said end beams so that the lower surface of each eave beam is in coplanar alignment with the lower surfaces of said end beams; and roof panels spanning the space between said ridge beams and said eave beams, and sloping from the ridge beam downwardly toward the eave beams when the end beams and said eave beams are supported by the upper sides of said side walls and said end walls when the side walls and the end walls are pivoted to their expanded, operative positions.

9. A modular building unit as defined in claim 8 wherein said end walls can be quickly connected or disconnected from the remaining portions of said building.

10. A modular building unit as defined in claim 8 wherein said end walls are removable from the building unit to permit a plurality of said units to be joined in end-to-end relation with a continuous, communicating space defined within the joined units.

11. A modular building unit as defined in claim 8 further characterized as including:

a horizontally extending floor; and means for detachably latching the lower edges of said end walls to said floor.

* * * * *